US006868626B1

(12) United States Patent
Linkous

(10) Patent No.: US 6,868,626 B1
(45) Date of Patent: Mar. 22, 2005

(54) METHOD AND DEVICE FOR MOUNTING NEEDLEWORK

(76) Inventor: Kelvin Linkous, 495 Teel Brooke Rd., Rocky Mount, VA (US) 24151

( * ) Notice: Subject to any disclaimer, the term of this patent is extended or adjusted under 35 U.S.C. 154(b) by 285 days.

(21) Appl. No.: 10/199,694

(22) Filed: Jul. 19, 2002

Related U.S. Application Data

(60) Provisional application No. 60/306,477, filed on Jul. 19, 2001.

(51) Int. Cl.[7] ..... D06C 3/08

(52) U.S. Cl. ..... 38/102.91

(58) Field of Search ..... 38/102.2, 102.3, 38/102.9, 102.91; 206/574, 575; 40/736, 738, 740, 743, 794, 798; 160/371; 428/13, 14; 2/244, 246, 108, DIG. 7

(56) References Cited

U.S. PATENT DOCUMENTS

| | | | | |
|---|---|---|---|---|
| 3,412,521 A | | 11/1968 | Bauman | |
| 3,885,333 A | | 5/1975 | Zachary | |
| 3,968,620 A | | 7/1976 | Keltner | |
| 4,058,215 A | | 11/1977 | Marchbank | |
| 4,233,765 A | | 11/1980 | O'Mullan et al. | |
| 4,279,087 A | | 7/1981 | Crawford | |
| 4,411,364 A | * | 10/1983 | Friedman | 206/466 |
| 4,451,997 A | | 6/1984 | Jones | |
| 4,620,633 A | | 11/1986 | Lookholder | |
| 4,642,923 A | | 2/1987 | Mueller | |
| 4,726,130 A | | 2/1988 | Bussard | |
| 4,936,460 A | | 6/1990 | Meyer | |
| 5,033,529 A | | 7/1991 | Koschade | |
| 5,129,519 A | | 7/1992 | David et al. | |
| 5,133,140 A | | 7/1992 | Frey | |
| 5,402,892 A | | 4/1995 | Jaszai | |
| 5,515,975 A | | 5/1996 | Jarvis et al. | |
| 5,564,570 A | | 10/1996 | Jaszai | |
| 5,878,551 A | * | 3/1999 | Curley et al. | 53/434 |
| 6,029,280 A | * | 2/2000 | Sloot | 2/243.1 |
| 6,164,228 A | * | 12/2000 | Lin et al. | 112/475.22 |
| 6,544,100 B1 | * | 4/2003 | Nadsady et al. | 450/38 |

* cited by examiner

*Primary Examiner*—Ismael Izaguirre
(74) *Attorney, Agent, or Firm*—Jagtiani + Guttag

(57) ABSTRACT

A mounting system for easily mounting flexible materials, such as needlepoint, is disclosed. The system uses a compressed foam unit placed between the flexible material and a mounting member. The compressed foam unit consists of a foam material sealed between two sheets of air impermeable material with the air having been removed. Once the flexible material is secured to the mounting member, the air impermeable material is punctured and the foam returns to its original state, thereby stretching the material.

18 Claims, 8 Drawing Sheets

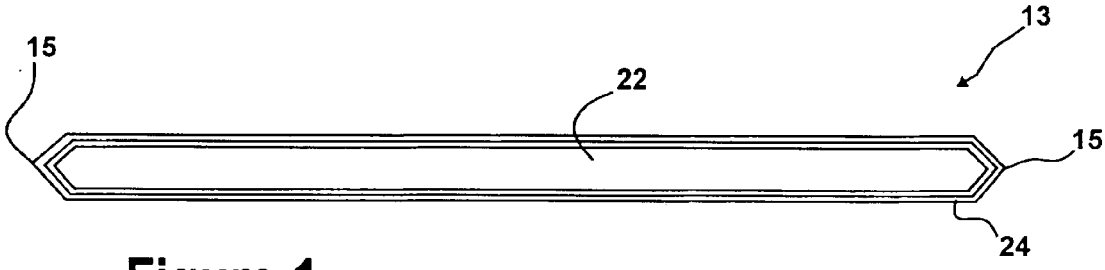
Figure 1
Figure 2
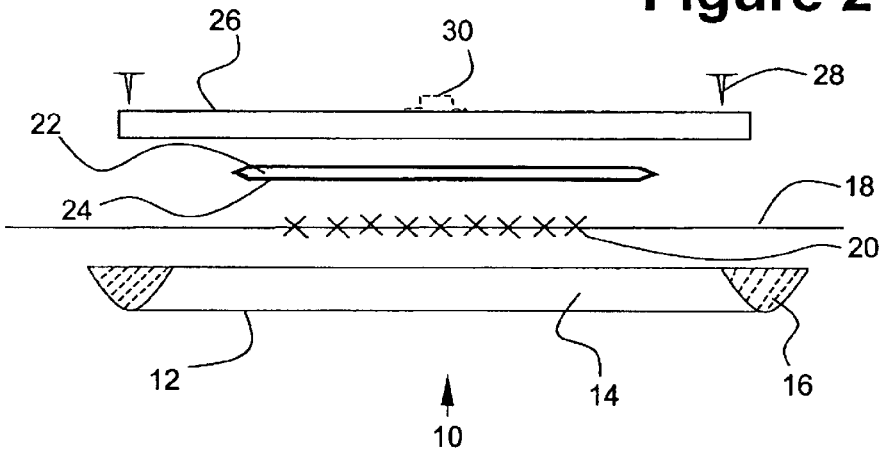
Figure 3
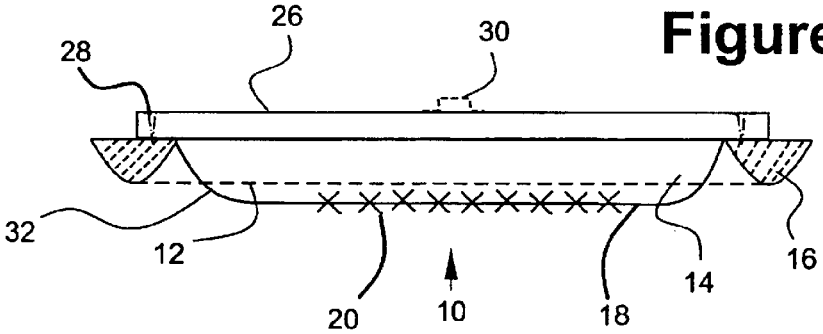

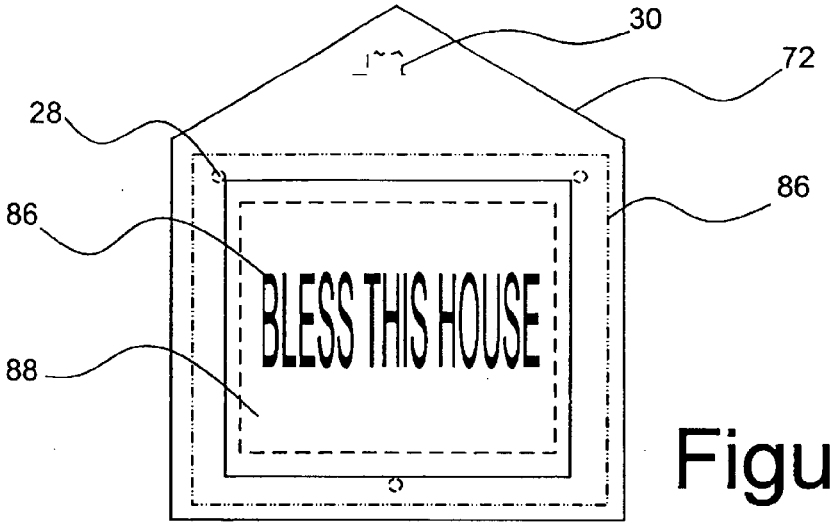
Figure 6a
Figure 6b
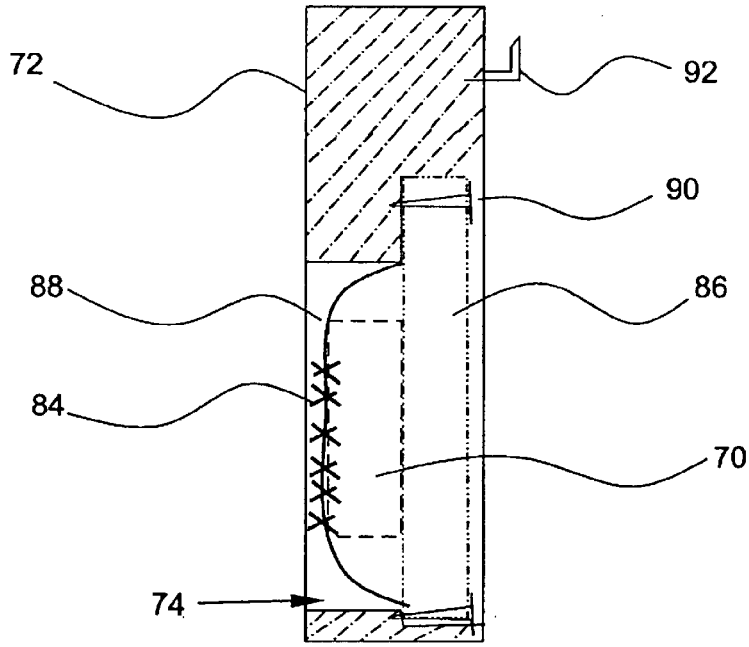

Figure 7
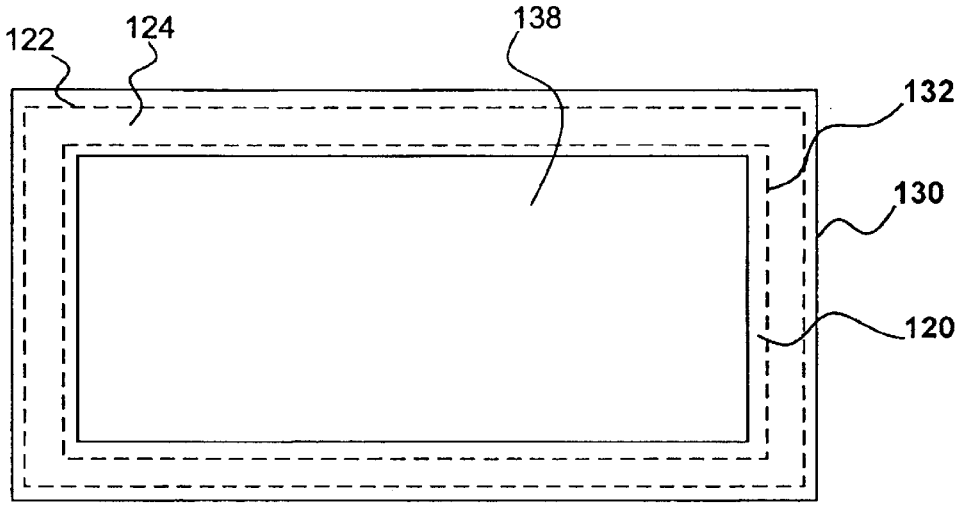
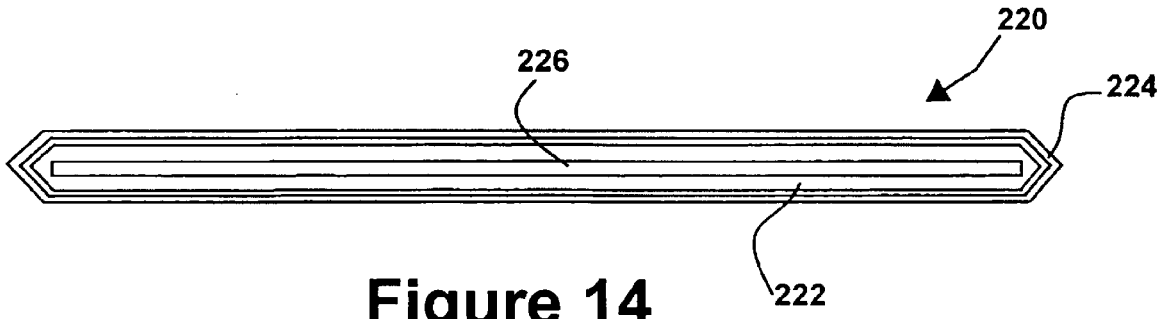
Figure 14

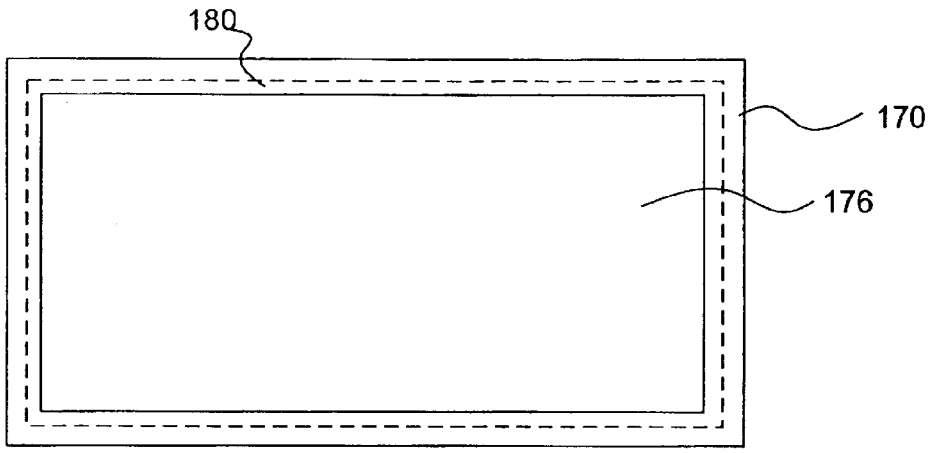
Figure 8a
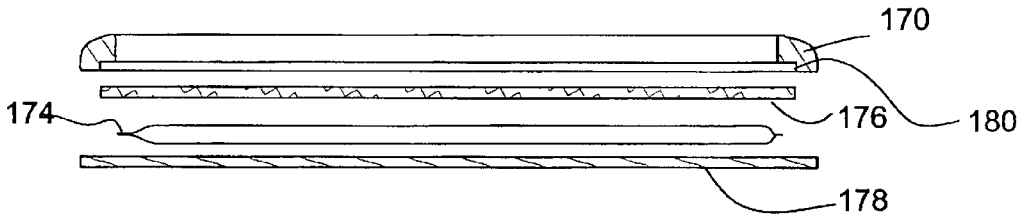
Figure 8b
Figure 8c
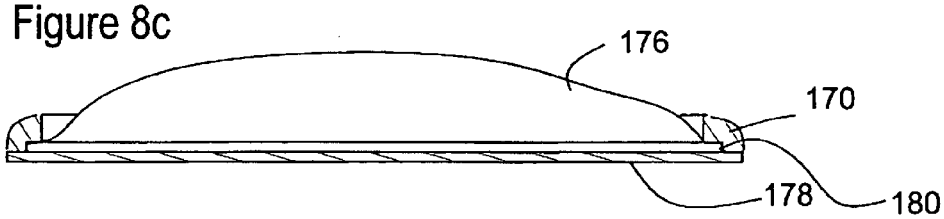

METHOD AND DEVICE FOR MOUNTING NEEDLEWORK

This application claims the benefit of Provisional Ser. No. 60/306,477 filed Jul. 19, 2001.

FIELD OF THE INVENTION

The instant invention relates to the field of mounting fabric art objects, particularly cloth ornaments and needlework, and more particularly to the mounting of the art object easily and efficiently and further to the stretching of the fabric to make it appear more pleasing and display with a true presentation. Still further, the method of the present invention provides to the mounting onto utilitarian surfaces and to providing a three dimensional effect.

DESCRIPTION OF THE PRIOR ART

Methods and devices for framing and displaying art objects are well known. Art objects such as paintings, posters, photographs, textiles and the like are best displayed in a manner which reduces the possibility of wrinkling, bunching or other imperfections which detract from the object's appearance. Needlework and fabric art such as needlepoint and cross stitch embroidery are frequently displayed by mounting them first a mounting board, typically a stiff cardboard material, over which the fabric is stretch and affixed prior to framing. Squaring or proper positioning of the needlework is important in creating a pleasing appearance. Original techniques for fixing the artwork to the mounting board included gluing, stapling and stitching, all of which were time consuming and required considerable care in order to make the finished product more pleasing to the eye. Glue can be messy and can leave residue in places that are visible in the mounted product. Stapling and stitching can be time consuming and inaccurate and do not prevent bunching which can occur due to relaxation of the fabric. These complications make framing needlework more of a chore than an enjoyable task and do not assure a properly positioned display.

A variety of framing systems for mounting needlework exist. Box type frames and fabric stretchers such as those described in U.S. Pat. No. 4,279,087 to Crawford, U.S. Pat. No. 4,233,765 to O'Mullan and Hahn, and U.S. Pat. No. 4,451,997 to Jones are useful for display but suffer from many of the same limitations described above. Hoop type frames and canvas stretchers such as those described in U.S. Pat. No. 4,726,130 to Bussard and U.S. Pat. No. 3,885,333 to Zachary are easier to use but are not as attractive as picture frames. All of the described framing systems are not designed for uses beyond simple display and are not easily configured for utilitarian use on household items such as canisters and baskets.

In order to make mounting easier and less troublesome, several patents are directed to new methods for stretching needlework and mounting fabric. One exemplary method includes that disclosed by Frey in U.S. Pat. No. 5,133,140. This method uses a frame with fabric-securing strips or moldings containing teeth. Fabric is stretched by hand and impaled on the teeth. This technique requires some manual dexterity and the teeth are potentially dangerous, particularly in the hands of children. The teeth can tear or shred the fabric, causing an undesired appearance of the displayed fabric. Furthermore, fabrics are pliant materials and this device does not eliminate the possibility of relaxation of the fabric over time causing deformation or unevenness after the needlework has been framed. Similarly, Koschade in U.S. Pat. No. 5,033,529 describes a panel fabric fastening system that uses fastening devices containing spikes to secure the fabric. The devices are mounted onto the edges of the panel. Again, the technique requires manual dexterity and the sharp edges of the pointed elements are potentially dangerous. Like the '140 patent, shredding or tearing of the fabric and relaxation after mounting are problems with this device.

In an alternative to spiked or toothed fabric mounting systems, Mueller in U.S. Pat. No. 4,642,923 describes a mounting board for needlework which uses a plurality of holes along the periphery of the board. The fabric is then stitched onto the mounting board using these holes. While this reduces the inaccuracy of mounting by stitching, it does not prevent relaxation of the fabric and deformation or shifting positions of the mounted needlework can still occur.

Marchbank in U.S. Pat. No. 4,058,215 describes a framed embroidery assembly which does not use stitching or spikes to mount the needlework. This device makes use of the requirement for the frame commonly used in embroidery. It modifies the existing embroidery frame to make it a permanent component of the mounted embroidery. The new frame is used to hold the fabric while embroidering. After the artwork is completed, a back member and resilient pad are added to complete the framing process. While this system works well for mounting and to eliminate deformation, it requires a specific purchase of the prepared framing and mounting materials. This limits the user's ability to select a housing which is desired and can increase the overall expense to the user. Finally, not all users desire the three-dimensional effect of the resilient pad but prefer a flat, non-distorted presentation. In order to provide the user with this preference, the '215 patent requires a number of resilient pads included in the frame kit, again increasing the overall expense of the system.

One of the immediate limitations of the above described systems for mounting needlework is that they are meant to mount the art purely for framing and display. None of the described systems have the flexibility for addition to articles of utilitarian use, such as music boxes, jewelry boxes, canister lids, basket lids and the like.

SUMMARY OF THE INVENTION

These and other disadvantages and limitations of the prior art are overcome by the present invention. The device combines the need for easier, low-cost methods for stretching and mounting needlework with a compressed and sealed foam backing system. Expandable foam, cut to the size and shape of the desired frame, is compressed by vacuum in a sealed system such as two layers of plastic, and then is used in between the needlework and the mounting board prior to framing. A hole is made in the sealed system to release the vacuum and the foam expands to its original state, stretching the fabric into the frame without the possibility of uneven stretching, deformation, bunching or other undesired problems. Different sizes and configurations of the device can be sold, allowing the user to select according to his or her design interests. The addition of a rigid, or semi-rigid board between one side of the foam and the plastic is possible to aid in handling and mounting. The device can provide a three-dimensional effect for ornaments and certain types of needlework or can be manufactured to maintain the displayed needlework with a relatively flat appearance. The system is designed specifically to provide an aesthetically pleasing appearance even before needlework is mounted, providing the user with a preview of the final appearance of the mounted artwork. Finally, the device can be used in a variety of configurations and for a variety of uses besides the typical use of framing for display. For example, the mounted needlework can be configured for use as the lid of a storage container, jewelry box, music box, or basket.

BRIEF DESCRIPTION OF THE DRAWINGS

The advantages of the instant disclosure will become more apparent when read with the specification and the drawings, wherein:

FIG. 1 is a cut away side view of the compressible foan unit;

FIG. 2 illustrates a cutaway, exploded side view of the elements in one embodiment of the invention;

FIG. 3 shows a side view of the assembled elements of FIG. 2;

FIG. 6*a* is a front of a third embodiment of the assembled frame;

FIG. 6*b* is a side view of the embodiment of FIG. 6*a;*

FIG. 7 shows a front view of an alternate embodiment of the compressed foam batting;

FIG. 8*a* shows a front view of an alternate embodiment of a frame;

FIG. 8*b* is a side view of the embodiment of FIG. 8*a*, illustrating the components in exploded style;

FIG. 8*c* is a cross-sectional side view of the embodiment of FIG. 8*b* illustrating the components in assembled form;

FIG. 14 is a cutaway side view of an alternate embodiment of the compressed foam unit.

DETAILED DESCRIPTION OF THE PREFERRED EMBODIMENTS OF THE INVENTION

Figure 4:
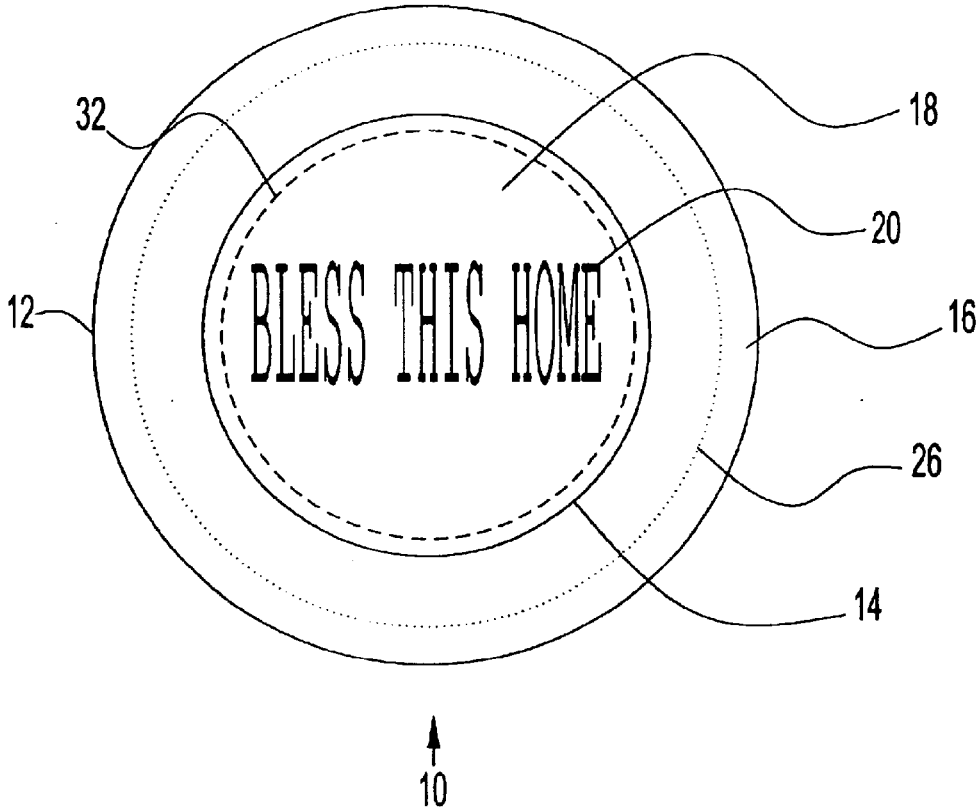
FIG. 4 shows a front view of the assembled frame of FIG. 3.

The instant invention is a device and method to mount needlework for display and/or improving the appearance of household items such as storage containers, furniture and the like. In particular, after needlework art such as cross-stitch or embroidery has been completed, the art can be easily displayed or placed onto various household items by the artist without the need for upholstery or framing skills. Furthermore, the instant invention provides a method for stretching needlework without using complicated attachment devices and provides for finished stretching after the needlework has been mounted to the frame or affixed onto the household items. The invention can be used for soft items, such as embroidered ornaments, to expand the fabric and give the ornament a three-dimensional appearance.

The disclosed mounting system is easy to assemble and use, as it requires no special skills in order to implement. The compressible foam is reusable and once the artist has decided to reframe the needlework, he or she can re-compress the expanded foam backing by applying pressure to the foam and forcing the air out the original expansion hole. The expansion hole is resealed by simply applying a piece of tape over the opening, making the compressible foam ready to use in another framing configuration.

The components of the mounting system include the frame, the compressed foam batting and the completed display material, such as needlework, and an optional backing member. The frame can be any size and configuration of commercially available frame with backing or can be specially made by or for the artisan. It should be noted that for ease of reference herein a frame refers to any material which surrounds a display member, including jelly jar rims, hoops, box tops, etc. The compressible foam is manufactured from polyethylene, polyurethane, polystyrene or other suitable materials, which is sized to fit the frame. Alternative materials can be used, however for most applications the material should have a smooth, rather than lumpy, surface when decompressed. In most embodiments, the expanded surface of the display material will be flat however, in some embodiments, the display material can be best shown with a variation in the lift. This can be accomplished by cutting the compressible foam in the desired three-dimensional design prior to covering with the plastic sheet. If any substantial variation in lift is required, a plastic sheet can be heat shrunk can be used to conform to the three-dimensional design prior to compression. The depth and density of the foam determine whether the display material will have a flat appearance or a three-dimensional once the air is reintroduced into the foam. An optional fifth component includes a rigid, or semi-rigid, member such as cardboard or plastic that is added to one side of the compressed foam batting between the compressible foam and the air impermeable seal to provide a firm backing for the foam insert.

To assemble the mounting assembly, the needlework is hand stretched across the opening of the frame and smoothed. The frame back with pad is then connected to hold all of the elements in place. The preferred adhesive is a compression adhesive similar to that found in Post-It-Notes so that the pad can be repositioned easily. In some embodiments, repositioning of the pad can be necessary to assure the pad is not caught between the frame and the back at any point around the perimeter. Whether or not this is repositioning is required will be dependent upon the embodiment used and will be evident during assembly. The edge of the needlework fabric is trimmed or folded as needed to meet the dimensions of the assembly and be properly centered such that the edge of the fabric does not extend beyond the outer perimeter of the frame.

Once a tight connection is made, a needle or pin is inserted through the needlework at a convenient and unobtrusive point and the sealed foam is penetrated. As air fills and expands the compressed foam, the needlework fabric is stretched into place and mounting occurs without the necessity of staples, nails, stitches or glue.

The compressible foam element can be any desired density, thickness, color or size and can be formed with or without internal openings. The foam may be trimmed or beveled to make the surface that contacts the needlework appear uniformly flat after exposure to the atmosphere. The perimeter of the foam can be cut follow the contour of the hermetic seal or to not follow the contour. The air impermeable plastic sheets that are used to hold the compressible foam can be made of various materials such as polyethylene/nylon blend, Mylar or StarVac II (Rexam Corporation, London, UK) and can be clear or colored to blend in with the needlecraft fabric or achieve a decorative effect. The hermetic seal of the plastic sheets can be heat sealed or adhesively bonded. The plastic sheets may be trimmed to mimic the perimeter of the compressible foam or excess plastic may be left in place to aid in mounting the batting to the frame member.

The Figures provide further detail on the instant invention and are beneficial to show some of the many options that can be derived from the invention. FIG. 1 illustrates the compressible foam unit 13 in the compressed position. The plastic sheet 24 can be sealed at ends 15 or in any other position convenient to manufacturing. The compressible foam 22 is, in the compressed position, conformed to the configuration of the plastic sheet 24.

Figure 12:
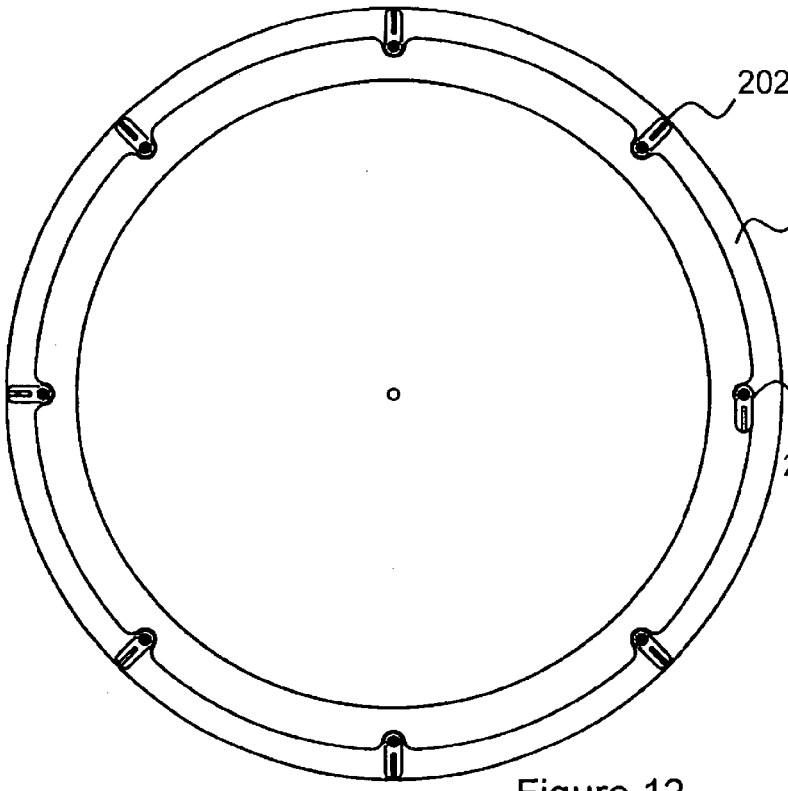
FIG. 12 is a front view of the back of the mounting system incorporating turn buttons.
Figure 13:
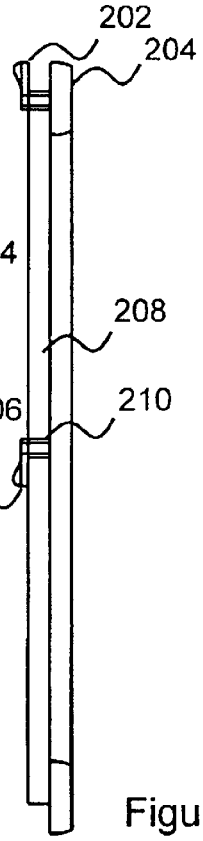
FIG. 13 is a side view of the embodiment of FIG. 12.

FIG. 2 shows an exploded cut away side view of one embodiment of the mounting system 10. The display member 12 is the first component and can be manufactured from any appropriate material such as wood, metal or plastic and can be plain, ornamented or decorated separately according to the user's desire. In this example, the display member 12 is circular in shape and has an opening 14 for viewing the display material, which in this example is a needleworked item 20. The dimensions of the perimeter 16, surrounding the opening 14, are generally an aesthetic issue, however sufficient material must be provided to secure the backing member 26 to the frame, taking into account the weight and resistance of the display material. The needlework fabric 18, with completed needlework 20, and the compressed foam unit 13 are placed in order and a backing member 26 is added thereafter. Fasteners 28 such as framer's points, screws, turn buttons, nails or other appropriate removable fastening items are used to finish the assembly and connect all pieces. Alternatively, permanent fastening means can be used, such as glue. In the preferred embodiments turn buttons, as described hereinafter in conjunction with FIGS. 12 and 13, are used to secure the backing members described herein. An optional hanger 30 can be added to the backing member 26 if so desired. If the needlework fabric 18 is larger than the dimensions of the display member 12, the fabric 18 can be folded around, and secured to, the backing member 26 using tape or other means. The backing member 26 is secured to the display member 12 as described. The centered, compressed foam 13 is maintained in place by virtue of being wedged between the needlework fabric 18 and the backing member 26.

Where the display member is an embroidery hoop, the assembly follows a similar procedure although no backing member is used. Instead, an inner and outer embroider hoop are connected with the fabric held between them. In this case, the compressed foam and seal are held in place by securing the plastic seal surrounding the compressed foam between the inner and outer embroidery hoops. The excess fabric and any excess plastic can be trimmed after all connections are made and the foam is expanded to improve the appearance.

In FIG. 3, the assembled mounting system 10 is shown after the plastic sheet 24 compressed foam unit 13 has been punctured. Following the example of FIG. 2, the circular display member 12, opening 14 and perimeter 16 with the completed needlework 20 and the expanded foam 32 having been pushed forward so that the needlework fabric 18 is fully stretched. In this example, the needlework fabric 18 extends beyond the limits of the display member 12. Although this is a common and desired effect, it is not an absolute and the needlework fabric 18 can meet or stay within the confines of the display member 12. The backing member 26 is attached with fasteners 28 and holds all elements securely in place. The optional hanger 30 is shown in case the user desires to hang the system 10 on a wall.

In FIG. 4, the assembled system 10 of FIG. 3 showing the circular display member 12, opening 14 and perimeter 16 are shown. The needlework fabric 18 with completed needlework 20 and the expanded foam 32 have now been pushed forward so that the needlework fabric 18 is fully stretched. In this embodiment, the backing member 26 has a radius that is slightly smaller than that of the display member 12. The backing member 26 is attached with fasteners to hold all elements securely in place.

Figure 5:
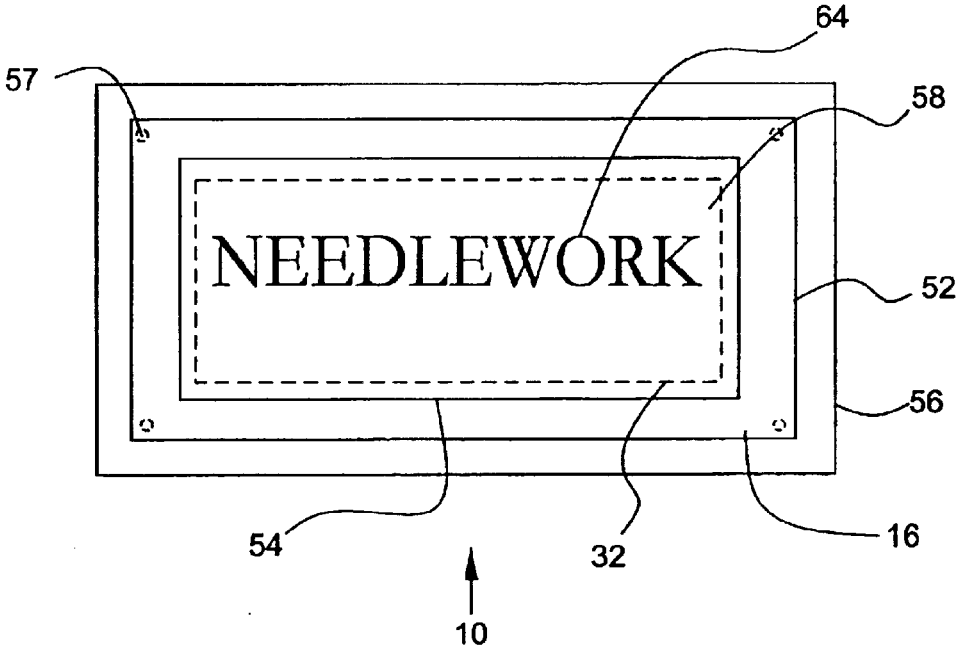
FIG. 5 shows a front view of a second embodiment of the assembled frame.

In FIG. 5 an alternative embodiment of the system 10 in FIG. 3 is illustrated wherein the display member 52 is rectangular and the backing member 56 has outer dimensions larger than those of the display member 52. The rectangular display member 52, opening 54 and perimeter 56 are shown. The needlework fabric 58 with completed needlework 64 and the expanded foam 32 are held in the expanded configuration by the backing member 56, fully stretching the needlework fabric 58. The rectangular backing member 56 is attached with fasteners 57 to hold all elements securely in place.

FIGS. 6*a* and 6*b* show another embodiment of the mounting system 10. In this example, the display member 72 is decoratively shaped and the backing member 86 has outer dimensions smaller than those of the display member 72. As can be seen in FIG. 6*b*, the display member 72 has a thickness greater than the combination of the backing member 86, the expanded foam unit 70 and needlework 84. The needlework fabric 88 with completed needlework 84 and the expanded foam 70 are pushed forward so that the needlework fabric 18 is fully stretched and, in this embodiment, forms an frustum rather than fill the entire receiving area 74. The square backing member 86 can be dimensioned to either recess within the display member 72 or to lie flush with the outside of the display member 72. The backing member 86, expanded foam unit 70 and needlework fabric 88 are held securely in place with fasteners 90. Finally, a hanger 92 is shown.

In FIG. 7 an alternate embodiment of the mounting system is shown which as a configuration similar to that of matting around a picture. In this embodiment, the sealed peripheral edge 130 of the plastic sheet is slightly less than the peripheral edge of the receiving frame (not shown). The dual plastic sheets 120 which would cover the entire area of the frame, encompass the compressed foam 124 and extend across the window area 138. The compressed foam 124, bound by the peripheral edge 130, extends only around the periphery of the receiving frame, as illustrated by foam 124 edges 122 and 132. Since the dual plastic sheets 120 cover the surface area of the frame, once the periphery edge 130 is sealed and the vacuum formed, there is no place for the air to escape. Therefore the interior seal 120 does not require the same hermetic sealing but rather serves to maintain the compressed foam 124 in place. In this embodiment, the foam 124 will expand around the periphery of the needlework rather than within the center of the needlework. This embodiment provides a flatter appearance rather than the curved, three-dimensional, appearance of the other embodiments. Alternatively, the compressed form, configured to cover the periphery, can be sealed on both the interior and exterior periphery and the sheets across the window region eliminated. In this instance, a light adhesive can be used to maintain the compressed foam in position.

This design can be shaped to match any style of display member including but not limited to round, oval and odd shaped patterns.

FIGS. 8*a*, 8*b* and 8*c* show an additional embodiment of the design of the system. The frame 170 in this Figure is rectangular shaped, however this should not be considered a limitation as any configuration can be used. A cutout 180 is formed in the frame 170 at the appropriate depth to provide a space for the compressed foam unit 174 and fabric 176 to rest. The compressed foam unit 174 is cut to match the outer periphery of the cutout 180 to enable the uncompressed foam pad 172 to expand through the entire area of the interior of the frame 170. The cutout region 180 is provided so that the fabric can slide between the backing member 178 and the frame 170, as the pad 172 expands to its full, uncompressed form. Alternatively, only the fabric can be placed within the cutout, with the compressed foam dimensioned to be slightly less, or equal to, the interior periphery of the frame. As taught herein, the aesthetic results are different based upon the placement of the compressed foam and the placement of the foam in this, and other embodiments, will be dependent upon the user.

In trimming or folding the needlework fabric to match the dimensions of the system, a simple method exists by using the display member and backing member of the desired design. The display member is placed with its opening over the completed needlework fabric so that the needlework image is positioned to the satisfaction of the user. The outer perimeter of the front member is then traced onto the fabric as a template for cutting or folding. If the display member has a smaller circumference or perimeter than the backing member, the template is complete and the fabric can be trimmed or folded prior to mounting. If the frame member has a larger circumference or perimeter than the backing member, the needlework fabric is positioned on the display, or frame, member so that the image is positioned to the satisfaction of the user. A second template is traced onto the fabric using the backing member positioned at equal distance on all sides within the tracing of the display member.

Figure 9:
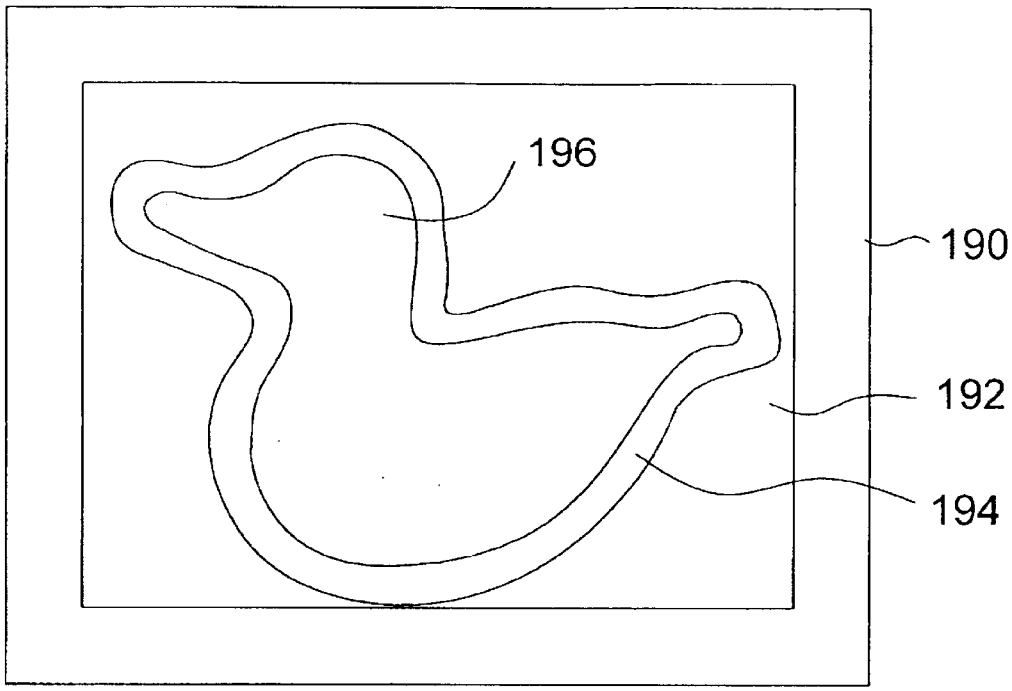
FIG. 9 is a rear view of a sculptured frame formed to accommodate a duck shaped object.
Figure 10:
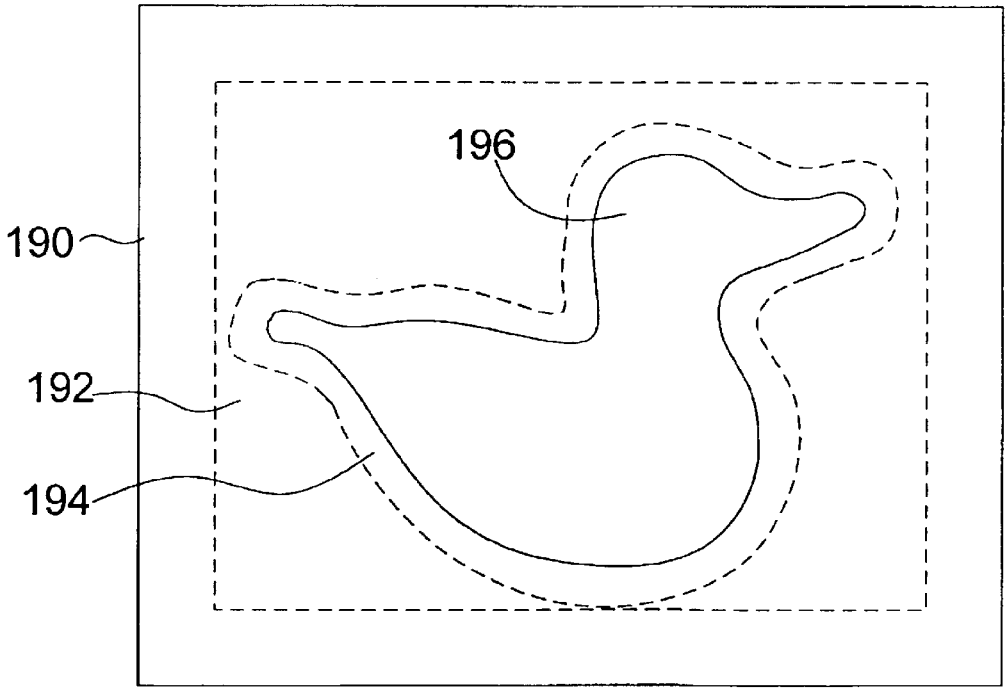
FIG. 10 is a front view of the frame of FIG. 9.
Figure 11:
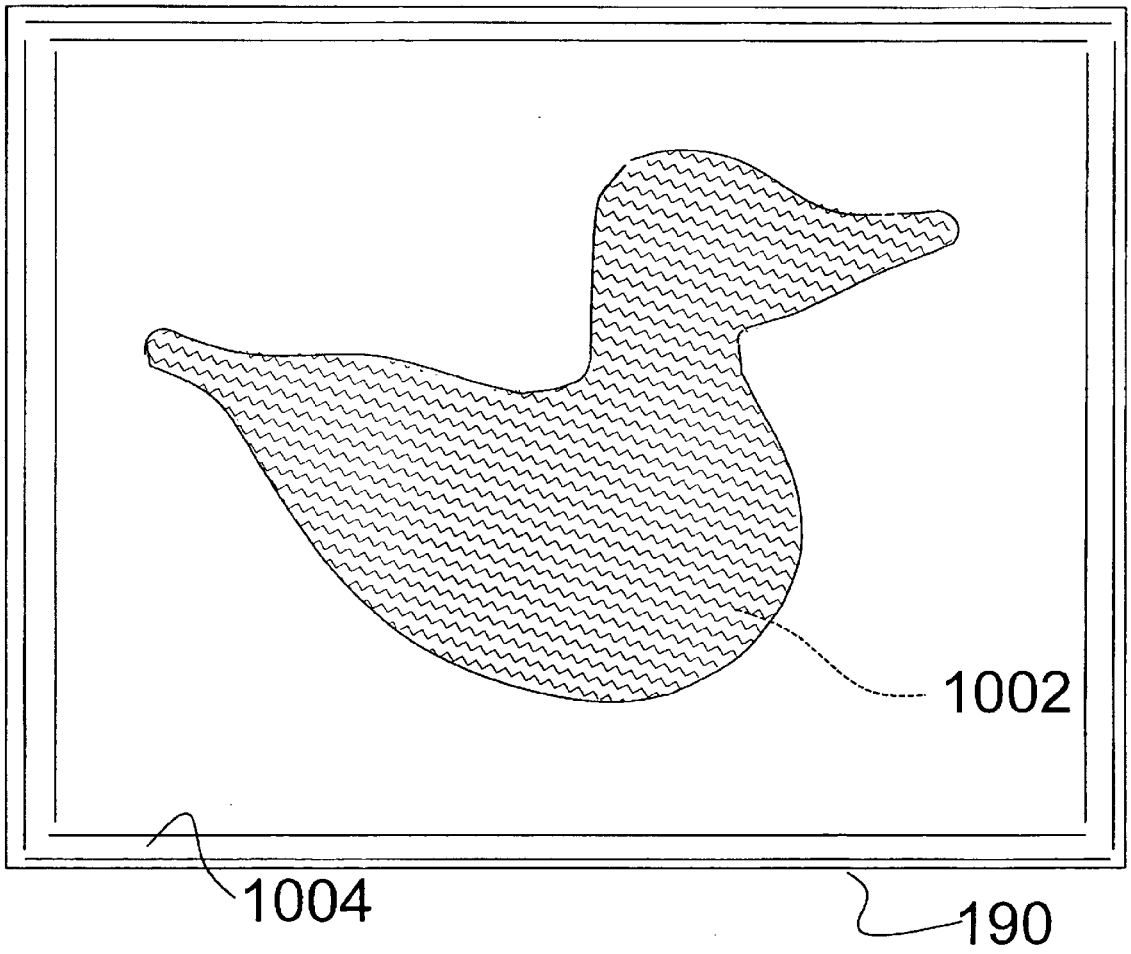
FIG. 11 is a front view of the assembled frame of the embodiment of FIGS. 9 and 10.

Odd shaped pads or frames can be used, as illustrated in FIGS. 9, 10 and 11 such as the shape of an animal or other object instead of simply comprising text. A combination of text and object design is also possible. When an odd shaped or asymmetrical pattern is used for the frame, a need exists to vary the thickness of the foam in regions of low surface area. This can be done using undercuts in areas of the pad that require contour. A contoured pad would be thicker in regions of low surface area and thinner in regions of high surface area in order to best stretch the fabric.

As seen in FIG. 9, the back side of the single piece frame 190 contains a cut out region 196 in the shape of a duck with a beveled region 194 provided to accommodate the expandable foam pad. The beveled region 194 is optional and will depend upon the design, depth of the foam, etc. The frame 190 can also have a slight etched region 192 to provide a slide area for the fabric. In the absence of the undercut region 194 and etched region 192, the backing member (not shown) would lock the fabric to the frame and the fabric would be restricted or prevented from stretching to the contour of the expanded pad in regions of low surface area. The dimensions of the undercut region 194 and etched region 192 are dependent upon the weight of the material and size of the framing member and will be evident to those skilled in the art. FIG. 10 shows the front side of the frame of FIG. 9, with the edges of the undercut region 194 and the etched region 192 being illustrated by dotted lines.

FIG. 11 illustrates the finished assembled product using the frame of FIGS. 9 and 10. The fabric 1002 is has a three-dimensional shape and the edge 1004 of the frame 190 can be rounded, beveled or otherwise contoured.

As stated heretofore, the preferred method of affixing the backing to the frame is through the use of turn buttons. As seen in FIGS. 12 and 13 this method requires no tools or skill as well as being quick and easy to complete; making it idea for children's craft projects. The frame 204 is provided with turn buttons 202 and 206 placed around the periphery. It should be noted that in this and other embodiments, the frame or support member can be a standard, self supporting structure or can be a lighter weight structure that interacts with and additional structure, such as a lid. The number of turn buttons 202 and 206 is dependent upon the size and the configuration of the frame 200 and will be evident to those skilled in the art. The placement of the turn buttons 202 and 206 around the periphery should be relatively evenly spaced and the distance from the periphery dependent upon the width of the frame. It is critical, however, that when placed in the closed position, as is button 206, that the turn buttons are not visible around the frame 204 periphery. As is seen more clearly in FIG. 12, the turn buttons 202 and 206 are spaced from the frame 204 through the use of spacers 210, or other methods known in the art, this permits free rotation of the turn buttons 202 and 206. The backing 208 is dimensioned to fit adjacent to the frame 204 and create a friction fit with the turn buttons 202 and 206. Although the closed turn button 206 is illustrated as only rotating a quarter turn, it should be noted that any degree of rotation that ensures that the turn button 206 overlaps the backing 208 sufficiently to maintain it in the secured position can be used.

In this, and any other embodiment, where there is an intermediate backing, the compressed foam can be directly adhered to the intermediate backing. For example, when the item being covered is a lid of a box or basket, the lid can be removed from the turn button hoop. The compressed foam can be directly adhered to the lid, the material placed over the foam and the turn button hoop replaced. The air can then be let back into the foam through any handle or knob access. The backing is then placed over the raw edges of the fabric on the lacing the foam on a flat surface and pressing down on the intermediate backing. Tape can then be placed over the hole in the intermediate backing.

An alternate embodiment for compressed foam unit described heretofore, is the compressed foam unit 220 illustrated in FIG. 14 which contains a cardboard, or plastic, internal panel 226. This panel 226 is sealed within the plastic sheets 224 and servers to rigidify the foam unit 220 during positioning.

To decorate household items such as canister and basket lids, the components can be modified to fit the item of interest. In the example of a canister lid, a two-piece assembly that is sized to fit the canister lid replaces the two-piece picture frame. This assembly can be round, oval, square, rectangular, or any shape that matches the dimensions of the desired household item. A rigid, or semi-rigid, front member of the two-piece assembly is the display portion of the frame with one or more openings where the needlework will be viewed. A backing member which fits onto the front member is included as the second part of the assembly. Both members can be comprised of wood, plastic, metal, heavy rubber or any other rigid, or semi-rigid material that is commonly used for frames and/or decorations. This backing member can fit onto the front member in a number of possible configurations, from flat against the front member to recessed into the front member. The backing member can likewise overlap the front member to provide an additional layer of aesthetic appeal.

The needlework is stretched across the opening or openings, the compressed and appropriately sized foam pad is placed thereafter and the backing member is added to complete the assembly. Nails, screws, turn buttons, tacks, brads or other appropriate fixing elements can be used to hold the front member to the backing member. The assembly can then be placed on the household item in a variety of ways including permanent fixing via nails or glue to impermanent fixing via screws, turn buttons, impermanent adhesives or Velcro® brand of hook and loop fastener. Alternatively, the mounting assembly can be used as the lid, with the original lid being used as the backing.

In the example of cloth ornaments, decorations and toys, the fabric is fastened together around the compressed and sealed foam batting and excess fabric is removed. All sides of the decoration can be needlework fabric or at least one side can be an undecorated fabric. Fastening of the fabric sides can be done by sewing, hot melt glue or other appropriate means for fastening fabric items. A needle or pin is inserted through one side of the decoration at a convenient and unobtrusive point and the sealed foam is penetrated. As air fills and expands the compressed foam, the needlework fabric is stretched into place and the ornament is provided with a soft, easy to create, three-dimensional appearance. Excess fabric can be trimmed to provide a more pleasing appearance.

A number of variations to the elements of the invention are possible. The two-piece frame can have a fully enclosed backing element or the backing element can align with the front element and contain the same hole or holes as the front element. The backing element can be the same size, smaller or larger than the front element. The backing element can fit in a recess within the front element or it can fit flush with the front element. The two elements can be any type of rigid, or semi-rigid, material and any color combination or covered with fabric.

Compressible foam packaging systems are known in the art. These packaging systems have a variety of uses and can be found in many products. Jaszai in U.S. Pat. Nos. 5,402,892 and 5,564,570 describes an impact resistant wrapping system comprised of compressed, elastic impact resistant material surrounded by flexible wall members having gas barrier properties. An air valve is added to allow the impact resistant material to expand under atmospheric pressure. The system is diverse and can be used to wrap or store a variety of products or items. The Jaszai system is used for transport and storage of items and needs, therefore, to use a heavier weight plastic than required for the disclosed invention. Additionally, the intent of the Jaszai device is to be reused and therefore incorporates a sealing member (19) to enabled repeated introduction and removal of the air. And although puncturing the seal is described, puncturing the plastic wrapping sheet is not. The use of the Jaszai sheets are not to provide a predefined shape to a stretched layer of material, but rather to cushion breakable materials. Therefore, the consistenancy of the "lift" in the Jaszai is not critical.

In other examples of compressible packaging, Jarvis et al describe an evacuated, encapsulated packaging system in U.S. Pat. No. 5,515,975. A sealed pliable bag containing loose articles with an air valve is placed on an item and the air evacuated, causing the pliable bag to rigidify around the shape of the article. Once the article, and accompanying bags, are placed in a container, air is reintroduced by puncture. This enables the bags to re-expand, contacting the article and walls of the container to hold the packaged items tight. Again, the concern is not an evenly distributed expansion, but rather the locking in of an article within a container. David et al in U.S. Pat. No. 5,129,519 describe a packaging container comprised of a mass of compressible material between a hermetic seal made of bonded inner and outer walls. Release of the seal expands the compressible material and stored or shipped items are protected with an impact resistant shield. In early examples of compressible packaging of this type, Lockholder, in U.S. Pat. No. 4,620,633 describes a protective envelope device for packaging fragile articles and Bauman in U.S. Pat. No. 3,412,521 describes a method for packaging articles. These systems are clearly intended for transport and storage of items and are not considered as a means for adding shape or stretching the items.

Meyer in U.S. Pat. No. 4,936,460 describes a vacuum packed stuffed toy for ease of display and flat stacking. Soft toys such as stuffed animals are packaged under compression between front and rear plastic sheets to which vacuum has been applied. The system is used to reduce size of the toy for display and the toy expands to its normal shape after vacuum has been released. The system is not intended for permanent mounting nor is it intended to stretch the fabric of the stiffed animals after mounting.

Keltner in U.S. Pat. No. 3,968,620 describes a method of compressing a foam article, such as pillows and stuffed animals within a plastic bag. Once the bag is removed, the animal or pillow is returned to its original shape, removing any wrinkles from the toys or pillows. In an alternate embodiment, a plastic bag is placed within the article and the foam forming the item expanded and compressed through the interior bag.

The preceding examples are provided for descriptive purposes solely and are not meant to limit the embodiments of the invention. Other configurations of the method and device for mounting needlework will become apparent to those of ordinary skill in the art.

What is claimed is:

1. A mounting system for flexible materials, said mounting system having a mounting member, securing means and a compressed foam unit, said compressed foam unit consisting of foam sealed within an air impermeable material and a backing member, said backing member being affixed to said mounting member.

2. The mounting system of claim 1 wherein said air impermeable material is puncturable to enable air to enter said compressed foam unit to decompress said compressed foam.

3. The mounting system of claim 1 wherein said mounting member is a frame having an open center area.

4. The mounting system of claim 3 wherein said compressed foam unit covers only said mounting member.

5. The mounting system of claim 3 wherein said foam covers only said mounting member and said impermeable material covers the surface area of said frame, including said open center area.

6. The mounting system of claim 5 further comprising an interior perimeter seal, said interior perimeter seal maintaining said foam in a predetermined position on said mounting surface.

7. The mounting system of claim 1 wherein said mounting surface has an etched section to receive said compressed foam unit and said flexible material.

8. The mounting system of claim 1 wherein said securing members are removable.

9. The mounting system of claim 1 wherein said securing members are turn buttons secured to said mounting member, said turn buttons being position on said mounting member to rotate to contact said backing member to form friction fit with said backing and flexible material combination.

10. The mounting system of claim 1 wherein said compressed foam unit further comprises an insert, said insert adding ity to said compressed foam unit.

11. The method of mounting a flexible material onto a mounting member using a compressed foam unit of foam compressed within an air impermeable material and securing members, comprising the steps of:

placing said compressed foam unit on a first side of said mounting member;

placing said flexible material over said compressed foam unit;

securing said flexible material to said mounting member with said securing members;

puncturing said compressed foam unit to expand said foam to its uncompressed size, and thereby stretching said flexible material to a taut configuration.

12. The method of claim 11 further comprising the step of placing a backing member over a second side of said mounting member to cover said secured flexible material.

13. The method of claim 12 further comprising the step of removably securing said backing member and said flexible material with turn buttons, said turn buttons being positioned on said mounting member to rotate to contact said backing member to form friction fit with said backing and flexible material combination.

14. The method of claim 11 further comprising the step of securing said compressed foam unit to a mounting member having an window, said compressed foam being mounted around said window, wherein said mounting member has a window region said compressed foam unit extending beyond said window region whereby decompressing said compressed foam causes said flexible material stretch across said window.

15. The method of claim 14 wherein said air impermeable material extends across said window.

16. The method of claim 11 further comprising the step of rigidifying said compressed foam unit by inserting a rigidifying member within said compressed foam unit.

17. A mounting system for flexible materials, said mounting system having:

a mounting member, a compressed foam unit, said compressed foam unit consisting of foam sealed within an air impermeable material, said air impermeable material being puncturable to enable air to enter said compressed foam unit to decompress said compressed foam; and a backing member, said backing member being affixed to said mounting member; removable securing means, said securing means affixing said flexible material, said compressed foam unit and said backing member to said mounting member, said mounting member being a frame having an open central area and a solid perimeter, said compressed foam unit being dimensioned to substantially cover said solid perimeter and said air impermeable material being dimensioned to cover the member area of said frame, including said open center area, said air impermeable material having an interior perimeter seal to maintain said foam in a predetermined position on said mounting member.

18. The mounting system of claim 17 wherein said securing means are turn buttons secured to said mounting member, said turn buttons being positioned on said mounting member to secure said flexible material, said compressed foam unit and said backing member to said mounting member, by rotating said turn button to contact said backing member after assembly.

* * * * *